US006274977B1

(12) United States Patent
Pyun et al.

(10) Patent No.: US 6,274,977 B1
(45) Date of Patent: Aug. 14, 2001

(54) CATHODE RAY TUBE WITH SPECIFICALLY SHAPED PANEL

(75) Inventors: Do-Houn Pyun; Wan Kim; Chan-Yong Kim, all of Kyungki-do (KR)

(73) Assignee: Samsung Display Devices Co., Ltd., Kyungki-Do (KR)

( * ) Notice: Subject to any disclaimer, the term of this patent is extended or adjusted under 35 U.S.C. 154(b) by 0 days.

(21) Appl. No.: 09/398,890

(22) Filed: Sep. 20, 1999

(30) Foreign Application Priority Data

Jan. 20, 1999 (KR) ..... 99-1593

(51) Int. Cl.[7] ..... H01J 29/76
(52) U.S. Cl. ..... 313/477 R; 313/461; 313/408
(58) Field of Search ..... 313/477 R, 408, 313/403, 407, 402, 461, 415, 463; 220/2.1 A, 2.1 R

(56) References Cited

U.S. PATENT DOCUMENTS 6,157,124 * 12/2000 Wakasono ..... 313/461

FOREIGN PATENT DOCUMENTS

Hei 6 36710 2/1994 (JP) .

Hei 6 44926 2/1994 (JP) .

* cited by examiner

*Primary Examiner*—Nimeshkumar D. Patel
*Assistant Examiner*—Ken A. Berck
(74) *Attorney, Agent, or Firm*—Christie, Parker & Hale, LLP

(57) ABSTRACT

A CRT is provided with a panel having a curved inner phosphor-coated side, a substantially flat outer viewing screen side and a rectangular-shaped effective screen area ranged through the inner phosphor-coated side and the outer viewing screen side. A shadow mask faces the phosphor-coated side of the panel. The shadow mask is formed to the curved shape of the phosphor-coated side. The rectangular-shaped effective screen area of the panel has two horizontally parallel long sides meeting a vertical axis, two vertically parallel short sides extended perpendicular to the horizontal sides, and four boundary corners formed between the neighboring horizontal and vertical sides. The vertical sides meet a horizontal axis and each of the boundary sides meets a diagonal axis. The meeting point of a horizontal long side and the vertical axis has a thickness Tv. The meeting point of a vertical short side and the horizontal axis has a thickness Th. The meeting point of a boundary corner and the diagonal axis has a thickness Td. The thickness ratio of Tv to Td is in the range of $0.75 \leqq Tv/Td \leqq 0.93$, whereas the thickness ratio of Th to Td is in the range of $0.75 \leqq Th/Td \leqq 0.85$.

12 Claims, 3 Drawing Sheets

CATHODE RAY TUBE WITH SPECIFICALLY SHAPED PANEL

BACKGROUND OF THE INVENTION (a) Field of the Invention

The present invention relates to a cathode ray tube (CRT) and, more particularly, to a flat-panel CRT which can minimize raster distortion of electron beams while maintaining structural strength of a shadow mask.

(b) Description of the Related Art

Generally, a faceplate panel for CRTs is shaped like a convex lens. Both sides of the faceplate panel, an inner phosphor-coated side and an outer viewing screen side, have a curved shape. This is because the convex-shaped panel has advantages in various aspects such as convenience of formation, stability in strength, and adaptability for shadow mask application.

However, to the eyes of the viewer, it is desirable that the screen image should be displayed as substantially flat. For this reason, several attempts have been made to form both sides of the faceplate panel with a flat shape while maintaining the normal display characteristics of the CRT. It is found that when a flat panel is used for the display screen problems occur in the convergence characteristics of electron beams and in the strength of a shadow mask. For example, when the surface of the phosphor-coated side is flat-shaped, it becomes difficult to deflect three electron beams of red R, green G and blue B correctly on a suitable convergence point. Furthermore, because the shadow mask facing the inner side of the panel should be correspondingly flat-shaped, the desired strength of the shadow mask cannot be achieved through the common shadow mask forming technique.

In addition, there is a problem with the flat-panel CRT from the standpoint of the viewer. When the viewer watches a monitor with the flat-shaped faceplate panel, they feel that the screen image is sunken at its center portion while protruded at its peripheral portion.

Therefore, it is preferable in the shadow mask-formation typed CRTs that the outer viewing screen side is formed with a flat shape and the inner phosphor-coated side with a curved shape.

In such a faceplate panel, as an inner curvature radius becomes smaller, the formation characteristics of the panel can be improved and the corresponding shadow mask can be formed with a stable structure capable of reducing a doming phenomenon. However, when the inner curvature radius of the panel falls below a minimum value, the peripheral portion of the panel is undesirably thick and this results in poor production efficiency as well as high production cost. Furthermore, the large thickness of the peripheral portion has a poor transmission rate and ultimately causes brightness failure.

In order to overcome such problems, various techniques are proposed for the one-sided flat panel CRT application. For example, these kinds of techniques are disclosed in Japanese Patent Laid Open Publication Nos. Hei 36710 and Hei 6-44926. However, they do not specify technical details for preserving the structural strength of the shadow mask which should be redesigned pursuant to the curvature radii varied at the inner side of the panel.

Furthermore, they do not calibrate the desired thickness ratios of a diagonal portion of the panel to the peripheral portion for minimizing distortion of the screen image. Therefore, when the CRT panel is manufactured on the basis of the above-identified techniques, the aforementioned problems remain.

In the usual sized flat-panel CRTs of 21-inch, 25-inch and 29-inch, it turns out that the thickness ratios of the peripheral portion of the panel to the center portion are 3.13, 2.91 and 2.72, respectively. These ratios are so high that they result in bad production efficiency as well as brightness failure.

SUMMARY OF THE INVENTION

It is an object of the present invention to provide a CRT which can minimize raster distortion of electron beams while maintaining structural strength of a shadow mask.

This and other objects may be achieved by a CRT provided with a panel having an inner phosphor-coated side with a curved shape, an outer viewing screen side with a substantially flat shape, and a rectangular-shaped effective screen area ranged through the inner phosphor-coated side and the outer viewing screen side. A shadow mask faces the phosphor-coated side of the panel. The shadow mask is formed to be adapted to the curved shape of the phosphor-coated side. The panel is sealed to a funnel which is in turn connected to a neck having an electron gun therein.

The rectangular-shaped effective screen area of the panel has two horizontally parallel long sides meeting a vertical axis V1, two vertically parallel short sides extended perpendicular to the horizontal sides, and four boundary corners formed between the neighboring horizontal and vertical sides. The vertical sides meet a horizontal axis H1 and each of the boundary corners meet a diagonal axis D1.

The meeting point of the horizontal long side and the vertical axis V1 has a thickness Tv. The meeting point of the vertical short side and the horizontal axis H1 has a thickness Th. The meeting point of the boundary corner and the diagonal axis D1 has a thickness Td. The thickness ratio of Tv to Td is in the range of $0.75 \leqq Tv/Td \leqq 0.93$, whereas the thickness ratio of Th to Td is in the range of $0.75 \leqq Th/Td \leqq 0.85$.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Preferred embodiments of this invention will be explained with reference to the accompanying drawings.

Figure 1:
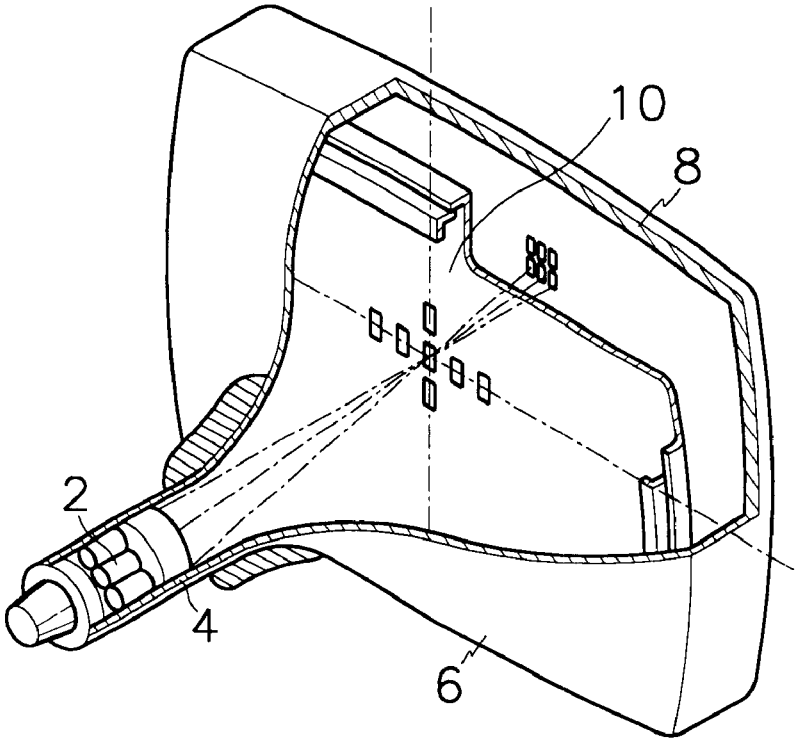
FIG. 1 is a fragmentary sectional perspective view of a CRT according to a preferred embodiment of the present invention.

FIG. 1 is a cut-away view of a CRT in accordance with the present invention. The CRT includes a neck 4 having an electron gun 2 therein, a funnel 6 integrally connected to the neck and a panel 8 sealed to the funnel.

The inner surface of the panel, coated with phosphors, has a curvature and the outer surface is substantially flat. A shadow mask 10 is disposed spaced apart and facing the inner surface of the panel. The shadow mask is curved to substantially correspond to the curved inner surface of the panel.

Figure 2:
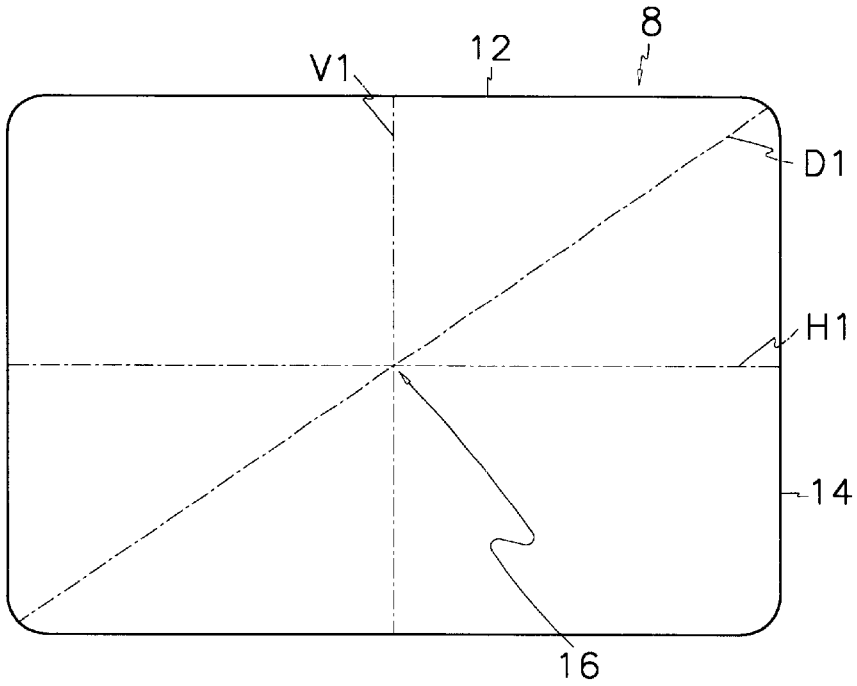
FIG. 2 is a front view of a panel shown in FIG. 1.

As shown in FIG. 2, the panel 8 has a rectangular effective screen area, a portion of the panel at which an image is actually formed is defined by two relatively long parallel sides 12, and two relatively short parallel sides 14. The vertical axis V1, horizontal axis H1 and diagonal axis D1 all pass through and intersect at the center 16 of the screen.

Figure 3:
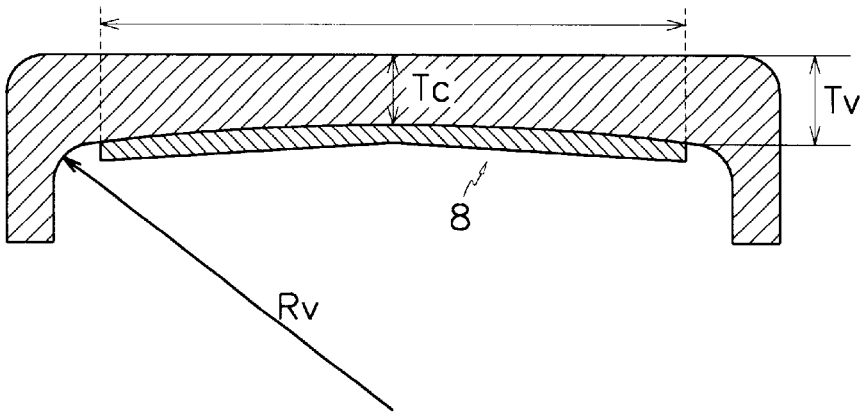
FIG. 3 is a sectional view of the panel shown in FIG. 2 cut along a vertical axis line.
Figure 4:
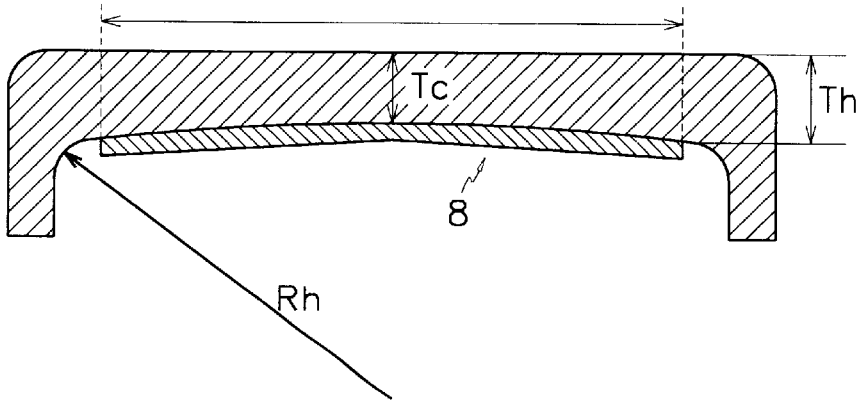
FIG. 4 is a sectional view of the panel shown in FIG. 2 cut along a horizontal axis line.
Figure 5:
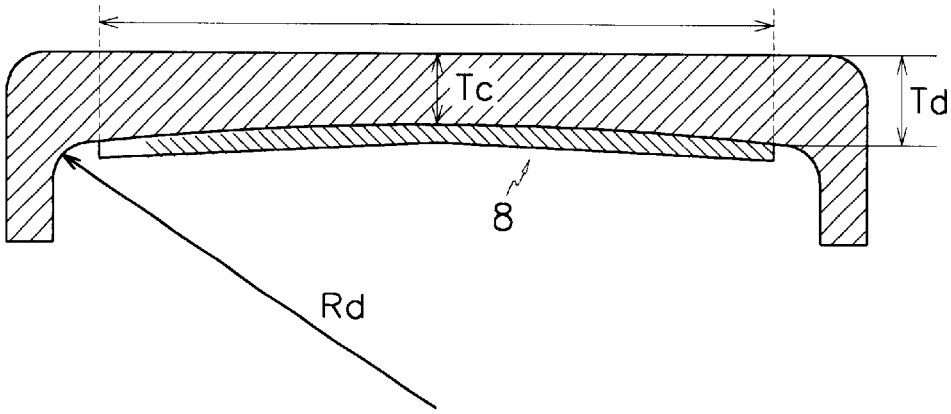
FIG. 5 is a sectional view of the panel shown in FIG. 2 cut along a diagonal axis line.

The thickness of the panel at a point where the vertical axis V1 crosses either of the long sides 12 is defined to be Tv. Next, the thickness of the panel at a point where the horizontal axis H1 crosses either of the short sides 14 is defined as Th. Finally, the thickness of the panel at a point where the diagonal axis D1 meets the boundary of the effective screen area is defined as Td. As illustrated in FIGS. 3–5 each of the thicknesses Tv, Th and Td is greatest in the cross sections cut along V1, H1 and D1 respectively.

A primary novel feature of the present invention lies in the relation among the three thicknesses as follows.

$$0.75 \leqq Tv/Td \leqq 0.93$$

$$0.76 \leqq Th/Td \leqq 0.85$$

If the thickness ratios Tv/Td and Th/Td are less than 0.75 and 0.76 respectively, a shadow mask that is supposed to have a similar curvature, can not maintain adequate structural strength because its overall curvature is too small. On the other hand, if the thickness ratios Tv/Td and Th/Td are greater than 0.93 and 0.85 respectively, deflected electron beams suffer raster distortions and light transmission in the periphery of the panel becomes poor.

The values satisfying the above thickness ratios in a 25-inch CRT panel and a 29-inch CRT panel are indicated in Table 1.

TABLE 1

| | 25-inch CRT panel | 29-inch CRT panel |
|---|---|---|
| Th (mm) | 20.0 | 22.3 |
| Tv (mm) | 20.8 | 26.8 |
| Td (mm) | 25.4 | 29.1 |
| Th/Td | 0.79 | 0.77 |
| Tv/Td | 0.82 | 0.92 |

Meanwhile the thickness of the panel at its center 16 is defined to be Tc and is related to Td by the following formula.

$$Td/Tc<2$$

It was found that image distortion is minimized when the center thickness meets the above condition. Furthermore, thickness Th, Tv, Td and Tc are interrelated by the following formula.

$$Th/Tc<Tv/Tc<Td/Tc$$

The inner surface of the panel has curvature radii Rh at the horizontal axis H1, Rv at the Vertical axis V1 and Rd at the diagonal axis D1, which are related as follows.

$$Rv<Rd<Rh.$$

As described above, the inventive CRT is provided with a panel which has optimum peripheral thickness ratios as well as optimum curvature radii, contributing to reduced raster distortion and, at the same time, allowing a corresponding shadow mask with good structural strength.

What is claimed is:

1. A cathode ray tube comprising:

a panel having an inner phosphor-coated side with a curved shape, an outer viewing screen side with a substantially flat shape, and a rectangular-shaped effective screen area ranged through the inner phosphor-coated side and the outer viewing screen side;

a shadow mask facing the phosphor-coated side of the panel, the shadow mask being formed to be adapted to the curved shape of the phosphor-coated side;

a funnel sealed to a rear of the panel; and a neck connected to the funnel, the neck having an electron gun therein;

wherein the rectangular-shaped effective screen area of the panel has two horizontally parallel long sides meeting a vertical axis V1, two vertically parallel short sides extended perpendicular to the horizontal sides, the vertical sides meeting a horizontal axis H1, and four boundary sides formed between the neighboring horizontal and vertical sides, each of the boundary sides meeting a diagonal axis D1, the vertical, horizontal and diagonal axes crossing a point;

wherein the meeting point of the horizontal long side and the vertical axis V1 has a thickness Tv, the meeting point of the vertical short side and the horizontal axis H1 has a thickness Th, the meeting point of the boundary side and the diagonal axis D1 has a thickness Td, and the cross point of the vertical, horizontal and diagonal axes has a thickness Tc;

wherein the thicknesses Tv and Td satisfy the following mathematical formula 1:

$$0.75 \leqq Tv/Td \leqq 0.93; \quad \text{[Mathematical formula 1]}$$

wherein the thicknesses Th and Td satisfies the following mathematical formula 2:

$$0.75 \leqq Th/Td \leqq 0.85. \quad \text{[Mathematical formula 2]}$$

2. The cathode ray tube of claim 1 wherein the thicknesses Td and Tc satisfy the following mathematical formula 3:

$$Td/Tc \leqq 2. \quad \text{[Mathematical formula 3]}$$

3. The cathode ray tube of claim 1 wherein the inner phosphor-coated side of the panel has a curvature radius Rh at the horizontal axis, a curvature radius Rv at the vertical axis, and a curvature radius Rd at the diagonal axis, and wherein the curvature radii Rh, Rv and Rd satisfy the following mathematical formula 4:

$$Rv \leqq Rd \leqq Rh. \quad \text{[Mathematical formula 4]}$$

4. The cathode ray tube of claim 1 wherein the thicknesses Th, Tv, Td and Tc satisfy the following mathematical formula 5:

$$Th/Tc \leqq Tv/Tc \leqq Td/Tc. \quad \text{[Mathematical formula 5]}$$

5. The cathode ray tube of claim 2 wherein the thickness ratio of Td to Tc satisfies the mathematical formula 5.

6. A cathode ray tube comprising;

a face panel with substantially flat outer surface and a curved inner surface, Wherein the peripheral thicknesses of a portion of said panel corresponding to a rectangular effective screen/image area are greater than the center thickness and have an interrelation of $0.75<Tv/Td<0.93$ and $0.75<Th/Td<0.85$, where Tv is the thickness at a point on the vertical boundary of the effective screen area, where a vertical axis passing the center of the screen crosses, Th is the thickness at a point on the horizontal boundary of the effective screen area, where a horizontal axis passing the center of the screen crosses, Td is the thickness at a point on the corner boundary of the effective screen area, where a diagonal axis passing the center of the screen crosses.

7. A cathode ray tube comprising:

a panel having a curved inner phosphor-coated side, a substantially flat outer viewing screen side, and a rectangular-shaped effective screen area;

a shadow mask facing the phosphor-coated side of the panel, the shadow mask being adapted to the curved shape of the phosphor-coated side;

a funnel sealed to a rear of the panel; and a neck connected to the funnel, the neck having an electron gun therein;

wherein the rectangular-shaped effective screen area of the panel comprises two horizontal sides, two vertical sides, and four corners, one corner at each intersection of a horizontal and vertical side, said horizontal sides being longer than said vertical sides;

wherein the panel has a thickness Tv at the intersection of one of the horizontal sides and a vertical axis passing through the effective screen area, a thickness Th at the intersection of one of the vertical sides and a horizontal axis passing through the effective screen area, a thickness Td at the intersection of a diagonal axis passing through two of the corners, and a thickness Tc at an intersection of the vertical, horizontal and diagonal axes;

wherein the thickness Tv and Td satisfy the following mathematical formula:

$$0.75 \leqq Tv/Td \leqq 0.93;$$

wherein the thickness Th and Td satisfy the following mathematical formula:

$$0.75 \leqq Th/Td \leqq 0.85.$$

8. The cathode ray tube of claim 7 wherein the thicknesses Td and Tc satisfy the following mathematical formula:

$$Td/Tc \leqq 2.$$

9. The cathode ray tube of claim 7 wherein the inner phosphor-coated side of the panel has a curvature radius Rh along the horizontal axis, a curvature radius Rv along the vertical axis, and a curvature radius Rd along the diagonal axis, and wherein the curvature radii Rh, Rv and Rd satisfy the following mathematical formula:

$$Rv \leqq Rd \leqq Rh.$$

10. The cathode ray tube of claim 7 wherein the thicknesses Th, Tv, Td and Tc satisfy the following mathematical formula:

$$Th/Tc \leqq Tv/Tc \leqq Td/Tc.$$

11. The cathode ray tube of claim 8 wherein the thickness ratio of Td to Tc satisfies the mathematical formula:

$$Th/Tc \leqq Tv/Tc \leqq Td/Tc.$$

12. A cathode ray tube comprising;

a face panel with a substantially flat outer surface and a curved inner surface, wherein a peripheral thickness along portions of a rectangular effective screen area of the panel are greater than a center thickness, and satisfy $0.75<Tv/Td<0.93$ and $0.75<Th/Td<0.85$, where Tv is a thickness at a point on a vertical boundary of the effective screen area where a vertical axis passing through a center of the effective screen area crosses, Th is a thickness at a point on a horizontal boundary of the effective screen area where a horizontal axis passing through the center of the effective screen area crosses, and Td is a thickness at a point on a corner of the effective screen area where a diagonal axis passing through the center of the effective screen area crosses.

* * * * *